US007398865B2

(12) United States Patent
Felder et al.

(10) Patent No.: US 7,398,865 B2
(45) Date of Patent: Jul. 15, 2008

(54) ELEVATOR CAR OPERATING PANEL

(75) Inventors: Hugo Felder, Buchrain (CH); Dennys Taiana, Losone (CH); Marco Aluisetti, Locarno (CH)

(73) Assignee: Inventio AG, Hergiswil NW (CH)

( * ) Notice: Subject to any disclaimer, the term of this patent is extended or adjusted under 35 U.S.C. 154(b) by 525 days.

(21) Appl. No.: 11/102,022

(22) Filed: Apr. 8, 2005

(65) Prior Publication Data

US 2005/0224298 A1 Oct. 13, 2005

(30) Foreign Application Priority Data

Apr. 8, 2004 (EP) ..... 04405216

(51) Int. Cl.
*B66B 1/34* (2006.01)

(52) U.S. Cl. ..... 187/395; 187/901

(58) Field of Classification Search ..... 187/391–398, 187/414, 901

See application file for complete search history.

(56) References Cited

U.S. PATENT DOCUMENTS 5,454,448 A * 10/1995 Bittar et al. ..... 187/395
5,679,934 A * 10/1997 Juntunen et al. ..... 187/395
5,969,306 A * 10/1999 Velauthapillai et al. ..... 187/395
6,161,654 A 12/2000 Sirigu et al.
6,227,335 B1 5/2001 Koeppe, Jr. et al.
6,502,668 B1 * 1/2003 Chida et al. ..... 187/395
7,021,428 B2 * 4/2006 Han et al. ..... 187/395

FOREIGN PATENT DOCUMENTS

| | | |
|---|---|---|
| DE | 195 39 288 | 8/1996 |
| EP | 1 321 414 | 6/2003 |
| FR | 2 797 858 | 3/2001 |

* cited by examiner

*Primary Examiner*—Jonathan Salata
(74) *Attorney, Agent, or Firm*—Fraser Clemens Martin & Miller LLC; William J. Clemens

(57) ABSTRACT

An elevator car operating panel for registering elevator calls has a plurality of touch sensitive buttons freely configurable to correspond to floors of a building according to a specified configuration. The buttons are configured to be lighted with light of a first color when active in the specified configuration so as to be visible, and are configured to not be lighted when inactive in the specified configuration so as to be invisible.

10 Claims, 2 Drawing Sheets

Fig. 1
(PRIOR ART)
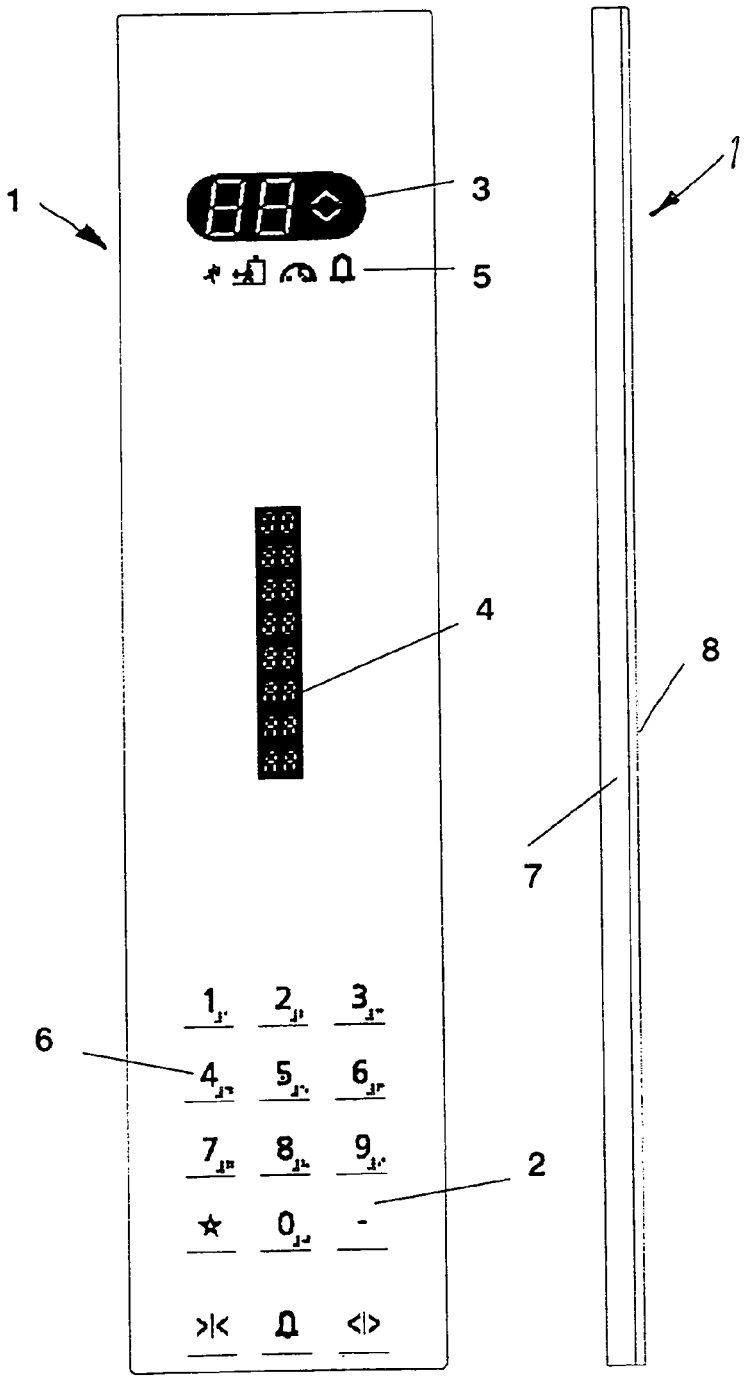
Fig. 1A
(PRIOR ART)
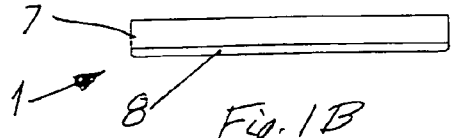
Fig. 1B
(PRIOR ART

ELEVATOR CAR OPERATING PANEL

BACKGROUND OF THE INVENTION

The present invention concerns an elevator with a car operating panel to register elevator calls In the new generations of inexpensive elevators for small buildings, there was introduced the concept of a car operating panel with a keypad exhibiting ten digits (0 to 9). This 10 digits-keypad system has reached the target of a unique factory produced car operating panel for all elevators, with evident cost and logistic advantages.

As an added feature, due to the presence of a 10 digits-keypad and several displays, the car panel could also be used as a maintenance tool.

Unfortunately, together with the advantages concerning the logistic and maintenance, derived by the fact that always the same car operating panel can be delivered, some important and advantageous features of the old customized car operating panels have been lost.

Unequivocal action of a button: a button identified by a certain number or letter had in the past only the function to place a call to the floor corresponding to said number. With a 10 digits-keypad solution this is no longer possible, since the button identified by the number 1, for example, is used in combination with other buttons to place elevator calls to the floors 12 or −1.

Multi-button input: the user interface of the elevator was a one-action machine-man interface. With a 10 digits-keypad solution the user interface of the elevator becomes a two-action machine-man interface, since, for example, to place a call to the floors 12 or −1, the user must push two buttons sequentially.

Optical acknowledgment: Because one button serves for different inputs, the optical acknowledgment of a pressed button and of a registered call would be equivocal.

Limits of the shaft: these are with a 10 digits-keypad solution no longer recognizable. The user cannot recognize if the uppermost floor of a building is the floor 6, 7, 10 or 12.

Nonexistent floors: the indication of all the 10 digits on the car operating panel disturbs the customers possessing elevators in buildings with only few floors, since they get confused by the presence of the highest digits (9, 8 . . . ), which do not correspond to any floor in the building.

It is necessary therefore to develop a standard car operating panel, which can be fully customized at the elevator installation itself and do not need special customizing operations in the factory. Said car operating panel can preferably be used without adding special components and exhibits also preferably a maintenance interface to change the elevator parameters.

An attempt to attain these goals is for example shown in German patent document DE 19539288 C2, in which a freely configurable and customizable car operating panel for elevator is disclosed, which exhibits freely programmable touch sensitive buttons and a maintenance mode for elevator service.

Such a car operating panel exhibits, however, the disadvantages of being expensive, not user-friendly, complex to be configured, and not esthetically attractive. Furthermore, this apparatus exhibits a difficult fabrication and assembly and cannot be produced using well-established components. The advantages for logistic are therefore lost.

Accordingly, it is an object of the present invention to provide a car operating panel for an elevator installation which is freely configurable, inexpensive, user-friendly, assembled using well-established standard components and esthetically attractive for the users.

SUMMARY OF THE INVENTION

A car operating panel, which solves this problem according to the present invention, registers elevator calls and includes touch sensitive buttons, wherein the buttons are freely configurable to correspond to floors of a building according to a specified configuration. The buttons are configured to be lighted with light of a first color, when active in the specified configuration, so as to be visible, and the buttons are configured to be unlighted, when inactive in the specified configuration, so as to be invisible.

Touch sensitive buttons are areas of the car operating panels, which can place an elevator call, when touched or even only skimmed for example by the human finger of an elevator user.

These buttons are meant to be freely configurable, wherein the floor to which they correspond and to which they place a call if touched, can be freely changed and programmed.

The set of combinations of button-floor constitutes a specified configuration, which can be set up for example by a service man at the moment of the installation of the elevator in a building, on the ground of the number of floors exhibited by the building.

If the buttons correspond to real and physical floor in a building, they are configured as active.

If the buttons do not correspond to any real and physical floor in the building, they are configured as inactive.

Active buttons are lighted, when a light source generates light making them visible and perceivable by a user by sight. Active buttons are also enabled by the elevator control to place calls.

The buttons are visible, wherein an elevator user can recognize by sight or touch that this car operating panel area is enabled to place an elevator call if touched.

If an elevator user cannot distinguish by his senses such an area as being able to place elevator calls, the button is said to be invisible.

The present invention exhibits the advantages that the claimed car operating panel can be freely configured according to the building in which is mounted in a very user-friendly way, without the need of expensive components or complex operations. Since the configuration is carried out only by lighting on or off determined areas of the car operating panel, corresponding respectively to the active and inactive touch sensitive buttons, said configuration can be carried out in a very fast, elegant and time non-consuming way. Additional mechanical components are not required, except for the light itself. The configuration can always be carried out on the same type of car operating panel, maintaining in such a way all logistic advantages offered by a unique factory produced car operating panel.

The buttons, when actuated to register an elevator call, are preferably configured to be lighted with light of a different color from the first color, in a manner that the acknowledgment of the elevator call is visible.

This preferred embodiment exhibits the advantage, that the elevator call is acknowledged in a user-friendly, evident and elegant way, without the need of additional and expensive components, electronic circuits or software routines, since the color change is easily, rapidly and intuitively perceived by the elevator user.

The car operating panel can exhibit a 10 digits-keypad consisting in a symmetric matrix of twelve configurable touch sensitive buttons arranged in three columns and four lines. Actually, this structure could be extended to a configuration with even more floors and there is no limitation.

This embodiment exhibits the advantage to use standard components already present nowadays in the market.

The configuration of the touch sensitive buttons is determined by the position of opaque strips arranged between a base and a covering of the car operating panel, in which strings the floor numbers are carved in such a way to be made visible if illuminated by light.

This embodiment exhibits the advantage that the configuration can be executed very rapidly with simple operations using very inexpensive components.

The active buttons can be configured to be lighted on with light of the first color, so as to be visible, for a configuration with floors in a range comprised between −3 and 8.

This embodiment exhibits the advantage to be suited to the most spread buildings and to the most common floor configurations, which occur in the market.

The numbers of the floors in a building corresponding to the buttons are indelibly indicated on the car operating panel, after that the specified configuration has been established at the moment of the installation of the elevator in the building.

This embodiment exhibits the advantage that an additional permanent indication of the floor configuration is provided.

The surface of the car operating panel is perfectly smooth and/or the touch sensitive buttons are operable through the disturbance of an electromagnetic field generated by a human finger.

This embodiment exhibits the advantage that the esthetic appearance is improved and that the force exerted by the finger can be reduced to a minimum or even be absent.

The first color pointing out that a button is active is blue and the second color acknowledging a registered elevator call is red.

This embodiment exhibits the advantage that the intuitive perception of the color change is maximized in the human brain.

The light of the second color acknowledging a registered elevator call blinks with a predetermined frequency.

This embodiment exhibits the advantage that the intuitive perception of the call placement is achieved even in case of people affected by Daltonism.

The buttons can be lighted by a backlight generated by LED's.

This embodiment exhibits the advantage that the light generating devices are very small and inexpensive.

The buttons are configurable to correspond to elevator operations and/or functions to be carried out and/or activated during maintenance or service.

This embodiment exhibits the advantage that an additional maintenance man-elevator interface is not required and place and costs can be saved.

A silk screen printing can be attached, with Braille signs in relief indicating the floors assigned to the buttons, in such a way that they are recognizable by a blind person. In addition, an orientation frame or line which localizes the touch area of the button can be provided.

This embodiment exhibits the advantage, that the elevator installation supports handicapped people in identifying the button in an easier way.

DESCRIPTION OF THE DRAWINGS

The above, as well as other advantages of the present invention will become readily apparent to those skilled in the art from the following detailed description of a preferred embodiment when considered in the light of the accompanying drawings in which:

FIG. 1 is a front elevation schematic representation of a prior art car operating panel with a 10 digits-keypad;

FIG. 1A is a side elevation view and FIG. 1B is a top plan view of the car operating panel shown in FIG. 1;

DESCRIPTION OF THE PREFERRED EMBODIMENT

Figures 2, 2A, 2B:
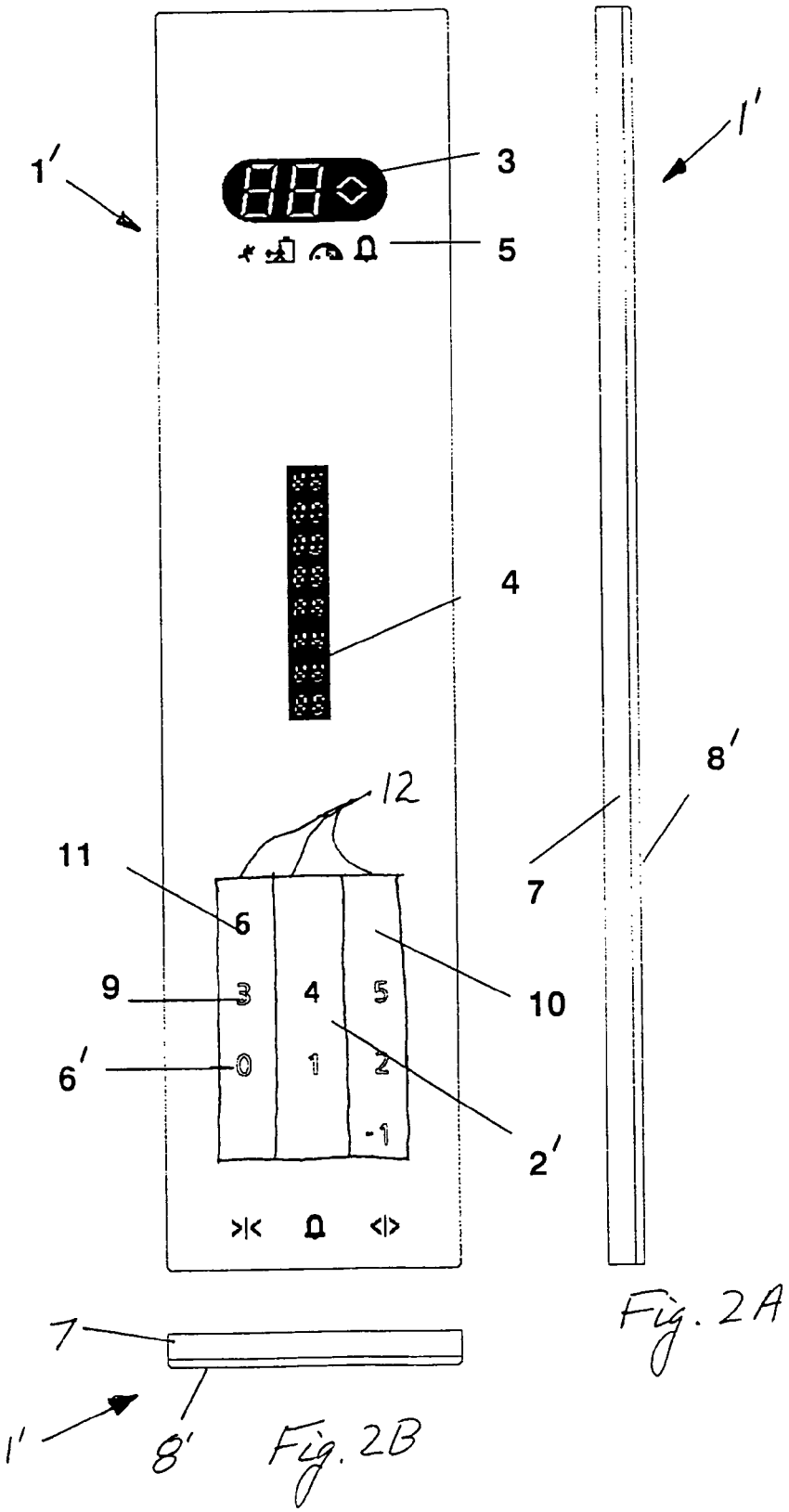
FIG. 2 is a front elevation schematic representation of a car operating panel according to the present invention.
FIG. 2A is a side elevation view and FIG. 2B is a top plan view of the car operating panel shown in FIG. 1.

FIGS. 1, 1A and 1B show a prior art car operating panel 1. The car operating panel 1 exhibits a keypad 2, which, in this example, is characterized by 10 digits (0 to 9) arranged in a predefined spatial order (10 digits-keypad). The keypad exhibits touch sensitive buttons 6, which are used to place elevator calls to the building floors. The floors corresponding to the touch buttons are indicated by contrasted markings indelibly stamped and visible on the keypad surface area. Capacitive sensors arranged behind the areas corresponding to the sensitive touch buttons produce an electro-magnetic field, which is disturbed by the touching of a human finger. In this way, the car operating panel 1 can detect elevator calls placed by a user and transmit them to the elevator control. The operating panel 1 is also provided with a position indicator 3, which displays at which floor the elevator car is traveling at a specific instant. A destination indicator 4 is also usually provided, which shows all calls that have been placed and must be still served. Auxiliary signs 5 are preferably provided, which point out special conditions of the elevator equipment, such as alarm, emergency and similar auxiliary indications. The alarm and emergency symbols are not visible in the normal use. Therefore, elevator users are not alarmed about this possibility. The car operating panel 1 is normally assembled by combining a cover 8 on a base 7.

This car operating panel 1 exhibits evident advantages from the point of view of the logistic, since a unique operating panel in this form can be produced industrially and introduced everywhere in different types of buildings, with dramatic cost advantages.

This car operating panel 1 exhibits, however, the disadvantage, that the 10 digits are always displayed on the keypad 2, since they have been indelibly stamped on the car operating panel surface. They are, for example, also displayed, when the car operating panel is mounted in a building with only two floors, in which the digits ranging from 3 to 9 would be unnecessary, which brings confusion and complains from the side of the concerned customers and users.

Furthermore, such a car operating panel is not configurable and the floors which correspond to determined areas of the keypad cannot be changed, since the markings on the sensitive touch buttons cannot be adapted.

This prevents, for example, such an operating panel to be adapted to buildings, where floors below the ground are present (−1, −2 . . . ) and to circumstances, where it would be desirable or compulsory to have the digit of the lowest floor in the lowest left area of the keypad.

FIGS. 2, 2A and 2B show a preferred embodiment of the present invention, which solves all cited problems.

In this embodiment, the digits provided on touch sensitive buttons 6' of a keypad 2', which correspond to floors which are effectively present in the building and which are therefore active, are made visible by a back-light generated by LED's (light emitting diode) emitting blue light. The active sensitive touch buttons 9 are therefore lighted-on and are clearly visible for the user. When the digit provided on the touch sensitive buttons 6' of the keypad does not correspond to a floor which is effectively present in the building and is therefore inactive, this digit is made invisible by switching off the corresponding LED's. Inactive sensitive touch buttons 10 are therefore not lighted and are totally invisible for the user. At the same time the elevator control stops these areas from being enabled to place elevator calls.

The touch sensitive buttons 6' are therefore freely configurable and can be customized to the building configuration in a very user-friendly and inexpensive way.

The digits representing the floors are obtained by cutting out the corresponding number in opaque strips. The strips are then inserted between the aluminum base 7 and the glass cover 8'. The position of the strips determines which numbers can be switched on or off by the LED's light and allows a total configurability of the elevator car operating panel 1' to be achieved. The glass cover 8' exhibits preferably also a translucent silk screen.

In the example of FIG. 2, three vertical strips 12 have been inserted side by side between the base and the cover. On the first strip 12 on the left the digits −3, 0, 3, 6, 9 (from the bottom to the top) have been cut.

On the second strip 12 from the left the digits −2, 1, 4, 7, 10 (from the bottom to the top) have been cut.

On the third strip 12 from the left the digits −1, 2, 5, 8, 11 (from the bottom to the top) have been cut.

By changing the order of the strips 12 and their relative vertical position it is possible to achieve all successions of digits, which are required by the floor configuration in the building, in which the car operating panel 1' has been installed.

The digits corresponding to the active floors must be so positioned on the keypad surface area that a light generating LED is provided below them, so that they can be back-lighted by the generated blue light.

In FIG. 2 the LED corresponding to the digits from 31 1 to 6 have been switched-on and make thus these digits visible, since the building in which the elevator has been installed exhibits the floors −1 to 6. The digits higher than 6 and lower than −1 are not visible, since the underlying LED's have been switched-off. These buttons correspond to nonexistent floors, are made invisible and are not allowed by the elevator control to place calls.

By positioning the opaque strips under the cover 8' and by switching on or off the LED's all possible successions of digits can be obtained. The car operating panel 1' is therefore totally configurable and can be customized to each building and required floor configuration.

Note that the components of the car operating panel 1' are always the same. The same covers, bases, strips and LED's arrangements must be produced by the elevator factory. From the point of view of the logistic and industrial production, no disadvantage occurs because of the introduction of the inventive car operating panel.

Note also that the configuration operations are very simple and do not require any special electronic hardware or software programs to be executed. The configuration can be carried out manually by any person in a very fast, user-friendly and inexpensive way by using well-established factory produced components.

With this concept, once defined the button symbols and the maximal number of call buttons, the car panel can be customized directly in the field without the need of a factory customization. The service man can define which call buttons have to be switched on or off by entering the lowest floor offset of the building. The elevator control knows how many floors are in the building and can activate automatically the necessary touch sensitive buttons.

In the preferred embodiment of FIG. 2 a button 11 actuated to register an elevator call, is configured to be lighted on with red light, in a different color from blue, the first mentioned color, in a manner that the acknowledgment of the elevator call is visible.

In addition to the color change from blue to red, the elevator call is also acknowledged by a blinking with a pre-determined frequency of the red light. An audible signal could be provided as well.

Because of esthetic reasons, the outwardly facing surface of the car operating panel 1' is perfectly smooth and the touch sensitive buttons 6' are operable through the disturbance of an electromagnetic field generated by a human finger and sensed by a capacitive sensor, so that any movable part can be eliminated in the car operating panel.

The numbers of the floors in a building corresponding to the buttons could be also indelibly indicated on the car operating panel, after that the specified configuration has been established at the moment of the installation of the elevator in the building, in a manner similar to that shown in FIG. 1.

FIG. 2 shows a car operating panel according to the present invention as installed in a building with floors ranging from −1 to 6. This car operating panel is suitable for a defined range of floors, e.g. between floors −3 to 8, the most used floor configurations and −1 to 6 was chosen in this case. Different configurations are possible inside this range e.g. −2 to 6, 0 to 8, −1 to 4, etc.

A silk screen printing can be attached on the car operating panel cover 8', with Braille signs in relief indicating the floors assigned to the buttons and in addition with an orientation frame or line, which localize the touch area of the button, in such a way that they are recognizable by a blind person The buttons 6' of the car operating panel 1' in FIG. 2 are configurable to correspond to elevator operations and functions to be carried out and activated during maintenance or service.

The maintenance interface is a classical 10 digits-keypad interface and is used as input for the maintenance and configuration functions of the elevator.

The car operating panel is entered in the configuration mode for example by pressing during ten seconds simultaneously the buttons door-open and door close.

A 10 digits-keypad configuration mode is then lighted on by the elevator control with a blue back-light.

A mask or a 10 digits-keypad button map must be used by the service engineer to find out the functions of the different buttons.

When a button is pressed, the backlight color changes to red, just as in the normal operation mode.

Unused buttons, even if present in the normal mode, are switched off in the 10 digits-keypad configuration mode.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car operating panel for registering elevator calls with touch sensitive buttons comprising:

a plurality of touch sensitive buttons freely configurable to correspond to floors of a building according to a specified configuration;

each of said buttons configured to be active in the specified configuration being lighted with a first color light so as to be visible; and each of said buttons configured to be inactive in the specified configuration not being lighted so as to be invisible, wherein the configuration of said touch sensitive buttons is determined by a position of opaque strips arranged between a base and a covering of the car operating panel in which said strips the floor numbers are carved in such a way to be made visible when illuminated by light.

2. The panel according to claim 1 wherein said active buttons, when actuated to register an elevator call, are configured to be lighted with light of a different color from said first color light so that acknowledgment of the elevator call is visible.

3. The panel according to claim 1 wherein said active buttons are configured to be lighted on with light of said first color so as to be visible for a floor configuration with floors in a range of −3 to 8.

4. The panel according to claim 1 wherein the numbers of the floors in a building corresponding to said active buttons are indelibly added on the car operating panel after the specified configuration has been established at the moment of the installation of the elevator in the building.

5. The panel according to claim 1 wherein an outwardly facing surface of the car operating panel is smooth and said buttons are operable through the disturbance of an electromagnetic field generated by a human finger.

6. The panel according to claim 1 wherein the first color indicating that one of said buttons is active is blue and said one button is lighted with a second color acknowledging a registered elevator call, the second color being red.

7. The panel according to claim 1 wherein a light of a second color acknowledging a registered elevator call blinks with a predetermined frequency to light an associated one of said active buttons.

8. The panel according to claim 1 wherein said active buttons are lighted by a backlight generated by at least one LED.

9. The panel according to claim 1 wherein said buttons are configurable to correspond to at least one of elevator operations and functions to be carried out or activated during maintenance or service.

10. The according to claim 1 wherein a silk screen printing is attached to the panel with Braille signs in relief indicating the floors assigned to said active buttons to be recognizable by a blind person.

* * * * *